US009163447B1

(12) United States Patent
Liang et al.

(10) Patent No.: US 9,163,447 B1
(45) Date of Patent: Oct. 20, 2015

(54) HINGE WITH DAMPING DEVICE

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/489,684

(22) Filed: Sep. 18, 2014

(51) Int. Cl.

| | |
|---|---|
| ***E05F 1/08*** | (2006.01) |
| ***E05F 5/00*** | (2006.01) |
| ***E05D 7/00*** | (2006.01) |

(52) U.S. Cl.
CPC .. *E05F 5/006* (2013.01); *E05D 7/00* (2013.01)

(58) Field of Classification Search
CPC ..... E05Y 2900/20; E05Y 2900/202; E05Y 2900/204; E05Y 2900/208; E05Y 2201/20; E05Y 2201/21; E05Y 2201/256; E05F 5/006; E05F 5/02; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 7,552,509 | B2 * | 6/2009 | Chen et al. | 16/50 |
| 8,561,262 | B1 | 10/2013 | Liang et al. | |
| 8,650,711 | B1 * | 2/2014 | Chen et al. | 16/54 |
| 9,057,214 | B2 * | 6/2015 | Salice | 16/286 |
| 2005/0015927 | A1 * | 1/2005 | Kropf | 16/286 |
| 2009/0119876 | A1 * | 5/2009 | Pecar et al. | 16/293 |
| 2011/0005032 | A1 * | 1/2011 | Domenig et al. | 16/54 |
| 2011/0291538 | A1 | 12/2011 | Brunnmayr | |
| 2011/0298349 | A1 * | 12/2011 | Sutterlutti | 312/326 |
| 2012/0174338 | A1 * | 7/2012 | Wu et al. | 16/297 |
| 2012/0180262 | A1 * | 7/2012 | Zimmer et al. | 16/319 |
| 2013/0000075 | A1 * | 1/2013 | Forster | 16/84 |
| 2013/0160242 | A1 * | 6/2013 | Brunnmayr | 16/286 |
| 2013/0167323 | A1 * | 7/2013 | Brunnmayr | 16/50 |
| 2014/0331451 | A1 * | 11/2014 | Holzapfel | 16/286 |
| 2014/0345081 | A1 * | 11/2014 | Salice | 16/50 |

FOREIGN PATENT DOCUMENTS

| | | | |
|---|---|---|---|
| CN | 201343946 Y | * | 11/2009 |
| CN | 103590693 A | * | 2/2014 |
| WO | WO 2012/024702 A1 | | 3/2012 |
| WO | WO 2012/024711 A1 | | 3/2012 |
| WO | WO 2012/045102 A1 | | 4/2012 |

* cited by examiner

*Primary Examiner* — Chuck Mah
(74) *Attorney, Agent, or Firm* — Rosenberg, Klein & Lee

(57) ABSTRACT

A hinge includes a hinge arm, a hinge cup, a spring, a retainer, a damper, and an adjusting member. When the hinge cup, which is pivotally connected to the hinge arm, is being closed relative thereto, the spring provides a resilient closing force to complete the closing action. The retainer is mounted in the hinge cup and has a channel. The damper is mounted in the channel and corresponds to the hinge arm to provide a damping force adjustable via the adjusting member, which is movably mounted to the retainer, includes a surface and at least two contact portions differently spaced from the surface, and can be adjusted relative to the retainer so that one of the contact portions corresponds to the damper.

20 Claims, 9 Drawing Sheets

HINGE WITH DAMPING DEVICE

FIELD OF THE INVENTION

The present invention relates to a hinge and, more particularly, to a hinge having a damping device capable of different damping actions.

BACKGROUND OF THE INVENTION

U.S. Pat. No. 8,561,262 B1 discloses a damping device for a hinge assembly. According to its specification, the damping hinge assembly includes a housing (10), an arm (12), at least one spring (14), a maintaining member (16), a damper (18), and an adjustment member (20). The arm (12) is pivotally connected to the housing (10). The housing (10) includes a chamber (36). The spring (14) is mounted in the chamber (36) of the housing (10) and serves to provide a resilient closing force when the housing (10) is pivoted with respect to the arm (12) and is thereby being closed with respect thereto.

The maintaining member (16) is fixedly mounted in the chamber (36) of the housing (10) and has a path (72) for receiving the damper (18). The damper (18) is mounted in the path (72) of the maintaining member (16) and corresponds to the arm (12). The damper (18) has a piston rod (76). The adjustment member (20) is movably mounted to the maintaining member (16) and has a protruded portion (92) to correspond to the piston rod (76) of the damper (18). When the adjustment member (20) has been displaced with respect to the maintaining member (16) to a first position, the protruded portion (92) of the adjustment member (20) is aligned with the piston rod (76) of the damper (18). Therefore, when the housing (10) is being closed with respect to the arm (12) in this state, the damper (18) is pushed and displaced by the arm (12). As a result, the piston rod (76) of the damper (18) is pressed against the protruded portion (92) of the adjustment member (20) and is thereby retracted to produce a damping effect. If the adjustment member (20) has been displaced with respect to the maintaining member (16) to a second position instead, the protruded portion (92) of the adjustment member (20) will not correspond in position to the piston rod (76) of the damper (18), and if the housing (10) is subsequently closed with respect to the arm (12), the piston rod (76) of the damper (18) will not be pressed against the protruded portion (92) of the adjustment member (20) and hence will not produce any damping effect.

In short, the piston rod (76) of the damping device can produce a damping effect when the adjustment member (20) has been displaced with respect to the maintaining member (16) to the first position, but if the adjustment member (20) has been displaced with respect to the maintaining member (16) to the second position, the piston rod (76) of the damping device cannot be pressed against the protruded portion of the adjustment member to produce the damping effect. In other words, the damping function of the damping device only has an ON state and an OFF state. Lacking a damping function adjusting mechanism, the damping device of the aforesaid US Patent still leaves room for improvement.

SUMMARY OF THE INVENTION

The present invention relates to a hinge which has a damping device capable of different damping actions.

According to one aspect of the present invention, a hinge includes a hinge arm, a hinge cup, at least one spring, a retainer, a damper, and an adjusting member. The hinge cup is pivotally connected to the hinge arm and includes a room. The at least one spring is mounted in the room of the hinge cup and serves to provide a resilient closing force when the hinge cup is pivoted with respect to the hinge arm and is thereby being closed with respect thereto. The retainer is mounted in the room of the hinge cup and has a channel. The damper is mounted in the channel of the retainer, corresponds to the hinge arm, and has a piston rod. The adjusting member is movably mounted to the retainer and includes a surface, a first contact portion, and a second contact portion. The first contact portion and the surface define a first distance therebetween while the second contact portion and the surface define a second distance therebetween. The first distance is greater than the second distance. When the adjusting member has been displaced with respect to the retainer to a first position, the first contact portion of the adjusting member corresponds to the piston rod of the damper, and when the hinge cup is subsequently closed with respect to the hinge arm, the damper is pushed and displaced by the hinge arm such that the piston rod of the damper is pressed against the first contact portion of the adjusting member and produces a damping effect. When the adjusting member has been displaced with respect to the retainer to a second position, the second contact portion of the adjusting member corresponds to the piston rod of the damper, and when the hinge cup is subsequently closed with respect to the hinge arm, the damper is pushed and displaced by the hinge arm such that the piston rod of the damper is pressed against the second contact portion of the adjusting member and produces a damping effect.

Preferably, the adjusting member has an engaging portion, the retainer has an upper portion, and the upper portion has a peripheral portion provided with a first engaging part and a second engaging part. When the adjusting member has been operated and thereby displaced with respect to the retainer to the first position, the engaging portion of the adjusting member is engaged with the first engaging part of the retainer. When the adjusting member has been operated and thereby displaced with respect to the retainer to the second position, the engaging portion of the adjusting member is engaged with the second engaging part of the retainer.

Preferably, the adjusting member further includes a third contact portion, the third contact portion and the surface define a third distance therebetween, and the second distance defined between the second contact portion and the surface is greater than the third distance. When the adjusting member has been displaced with respect to the retainer to a third position, the third contact portion of the adjusting member corresponds to the piston rod of the damper, and when the hinge cup is subsequently closed with respect to the hinge arm, the damper is pushed and displaced by the hinge arm such that the piston rod of the damper is pressed against the third contact portion of the adjusting member and produces a damping effect. In addition, the adjusting member preferably has an engaging portion, the retainer preferably has an upper portion, and the upper portion preferably has a peripheral portion provided with a first engaging part, a second engaging part, and a third engaging part. When the adjusting member has been operated and thereby displaced with respect to the retainer to the first position, the engaging portion of the adjusting member is engaged with the first engaging part of the retainer. When the adjusting member has been operated and thereby displaced with respect to the retainer to the second position, the engaging portion of the adjusting member is engaged with the second engaging part of the retainer. When the adjusting member has been operated and thereby displaced with respect to the retainer to the third position, the engaging portion of the adjusting member is engaged with the third engaging part of the retainer. Preferably, the retainer further has a lower portion opposite the upper portion and has a main body connected between the upper portion and the lower portion of the retainer, the lower portion has a peripheral portion provided with a lip, and the adjusting member is movably mounted between the upper portion and the lip of the lower portion of the retainer. Preferably, the adjusting member further includes an operating portion. It is also preferable that the upper portion of the retainer has a first mark, a second mark, and a third mark, and that the adjusting member further includes a pointed portion which corresponds to the first mark when the adjusting member has been displaced with respect to the retainer to the first position, the second mark when the adjusting member has been displaced with respect to the retainer to the second position, and the third mark when the adjusting member has been displaced with respect to the retainer to the third position.

Preferably, the hinge cup further includes a pair of sidewalls, a bottom wall connected between the pair of sidewalls, a front end wall connected between the front ends of the pair of sidewalls, and a rear end wall connected between the rear ends of the pair of sidewalls, wherein the pair of sidewalls, the bottom wall, the front end wall, and the rear end wall jointly define the room.

Alternatively, it is preferable that the hinge cup further includes a pair of sidewalls and a front end wall connected between the front ends of the pair of sidewalls, that each of the sidewalls has a shaft hole adjacent to the front end wall so that the shaft holes correspond to each other, that the hinge arm includes a pair of cam portions and a bushing connected between the pair of cam portions, and that the hinge arm is pivotally connected to the hinge cup by a shaft passing through the shaft hole of each of the sidewalls and the bushing of the hinge arm.

Preferably, the at least one spring includes a pair of springs which are in the form of torsion springs and each of which includes a winding portion. Preferably, the hinge cup further includes a pair of sidewalls and a bottom wall connected between the pair of sidewalls, each of the sidewalls has a pin hole so that the pin holes correspond to each other, the bottom wall includes a pair of lugs each having a through hole corresponding to the pin holes of the pair of sidewalls, each respective springs is mounted between a corresponding one of the pair of sidewalls and a corresponding one of the pair of lugs and is connected to the hinge cup by a respective pin which passes through the pin hole of the corresponding one of the pair of sidewalls, the winding portion of the each respective spring, and the through hole of the corresponding one of the pair of lugs.

Preferably, the hinge cup includes a pair of sidewalls, each of the sidewalls has a positioning hole so that the positioning holes correspond to each other, the retainer has two lateral sides each provided with an engaging element, and each of the engaging elements corresponds to and is engaged in a corresponding one of the positioning holes such that the retainer is fixed in the room of the hinge cup.

One of the features of the embodiments of the present invention is that the adjusting member has at least two contact portions which enable the piston rod of the damper to provide different damping actions. A user can choose the desired damping action to satisfy the operational needs in closing a door of a piece of furniture (or the like).

BRIEF DESCRIPTION OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
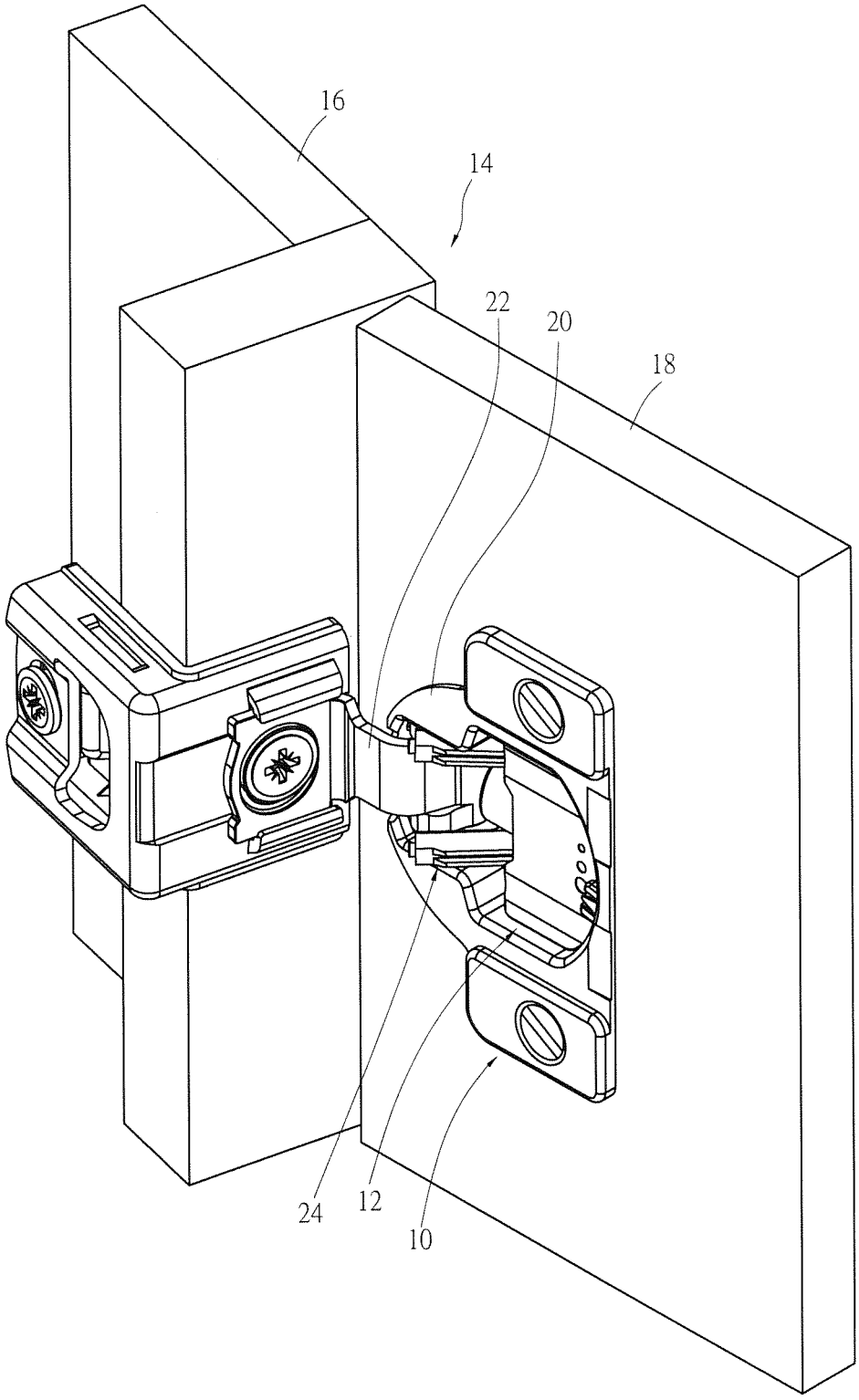
FIG. 1 is a perspective view in which a hinge with a damping device according to an embodiment of the present invention is applied to a cabinet.

FIG. 1 shows how a hinge 10 and a damping device 12 in an embodiment of the present invention are applied to a cabinet 14 (e.g., a cupboard or a similar piece of furniture). The cabinet 14 has a fixed portion 16 and a door 18. The door 18 can be opened and closed with respect to the fixed portion 16.

The hinge 10 includes a hinge cup 20, a hinge arm 22, and at least one spring 24. The hinge cup 20 is pivotally connected to the hinge arm 22 and is mounted to the door 18 of the cabinet 14. The hinge arm 22, on the other hand, is mounted to the fixed portion 16 of the cabinet 14. When the door 18 of the cabinet 14 is closed (or opened) with respect to the fixed portion 16, the hinge cup 20 is closed (or opened) with respect to the hinge arm 22. The at least one spring 24 and the damping device 12 are mounted in the hinge cup 20. In the course in which the hinge cup 20 is opened with respect to the hinge arm 22, the hinge cup 20 responds to the force generated by the at least one spring 24 and is subjected to an opening force, and in the course in which the hinge cup 20 is closed with respect to the hinge arm 22, the hinge cup 20 responds to the force generated by the damping device 12 and is subjected to a dampened closing force.

Figure 2:
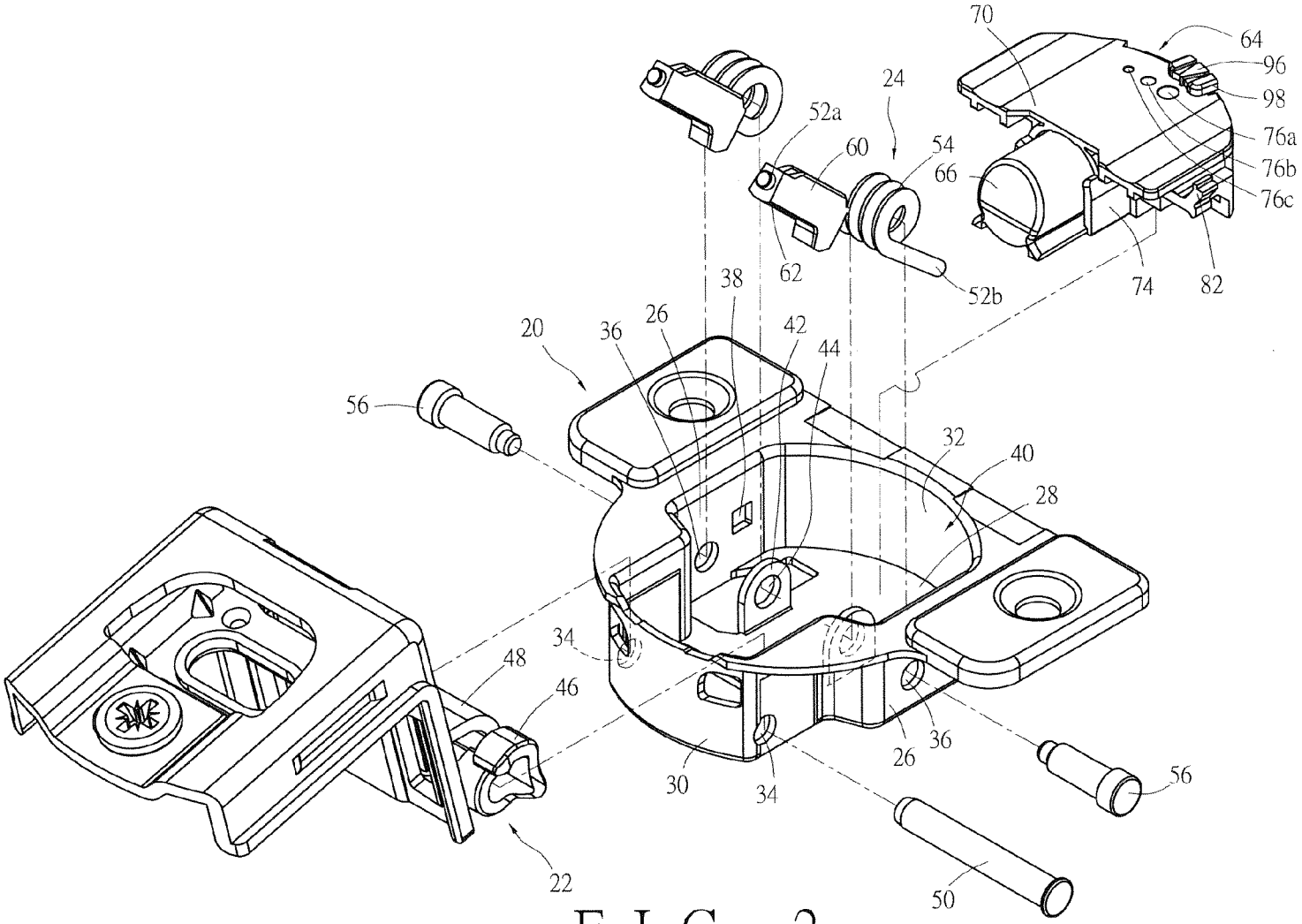
FIG. 2 is an exploded view of the hinge and the damping device shown in FIG. 1.

As shown in FIG. 1 and FIG. 2, the hinge cup 20 includes a pair of sidewalls 26, a bottom wall 28, a front end wall 30, and a rear end wall 32. The pair of sidewalls 26 have a pair of corresponding shaft holes 34 adjacent to the front end wall 30, a pair of corresponding pin holes 36, and a pair of corresponding positioning holes 38 (only one of the positioning holes 38 is shown in FIG. 2 due to limitation of the viewing angle). The bottom wall 28 extends and is connected between the bottoms of the pair of sidewalls 26. The front end wall 30 extends and is connected between the front ends of the pair of sidewalls 26. The rear end wall 32 extends and is connected between the rear ends of the pair of sidewalls 26. The pair of sidewalls 26, the bottom wall 28, the front end wall 30, and the rear end wall 32 jointly define a room 40. The bottom wall 28 includes a pair of lugs 42 within the room 40, each lug 42 having a through hole 44 corresponding to the pin holes 36 of the sidewalls 26.

The hinge arm 22 includes a pair of cam portions 46 (only one of the cam portions 46 is shown in FIG. 2 due to limitation of the viewing angle) and a bushing 48. The bushing 48 is connected between the cam portions 46. A shaft 50 passes through the shaft holes 34 of the hinge cup 20 and the bushing 48 of the hinge arm 22 such that the hinge arm 22 is pivotally connected to the hinge cup 20.

The at least one spring 24 is mounted at a proper position in the room 40 of the hinge cup 20. When the hinge cup 20 is pivoted with respect to the hinge arm 22 in order to be closed with respect thereto, the at least one spring 24 provides a resilient closing force in the last part of the closing movement. In one preferred embodiment, the at least one spring 24 is implemented by a pair of springs 24, but the number of the at least one spring 24 is not limited to two. The pair of springs 24 are in the form of torsion springs, each including a first rod 52*a*, a second rod 52*b*, and a winding portion 54 connected between the first rod 52*a* and the second rod 52*b*. Each respective spring 24 is mounted between a corresponding sidewall 26 and a corresponding lug 42 and is connected to the hinge cup 20 and secured in the room 40 by a respective pin 56 passing sequentially through the pin hole 36 of the corresponding sidewall 26, the winding portion 54 of the each respective spring 24, and the through hole 44 of the corresponding lug 42. In addition, the first rod 52*a* of each spring 24 presses against a corresponding cam portion 46 of the hinge arm 22.

Preferably, the first rod 52*a* of each spring 24 is mounted with a protective cover 60, and each protective cover 60 is made of plastic, for example, and has a columnar curved surface 62. Thus, thanks to the protective covers 60, the first rods 52*a* of the springs 24 will press against the respective cam portions 46 of the hinge arm 22 in an indirect manner to prevent product reliability issues which may otherwise occur if the cam portions 46 of the hinge arm 22 are in direct contact with and therefore subject to wear by the first rods 52*a* of the springs 24. Moreover, after the hinge 10 is used for a while, the columnar curved surface 62 of each protective cover 60 typically has an increased area of contact, and hence of friction, between itself and the corresponding cam portion 46, thereby stepping up the product's reliability in use.

Figure 3:
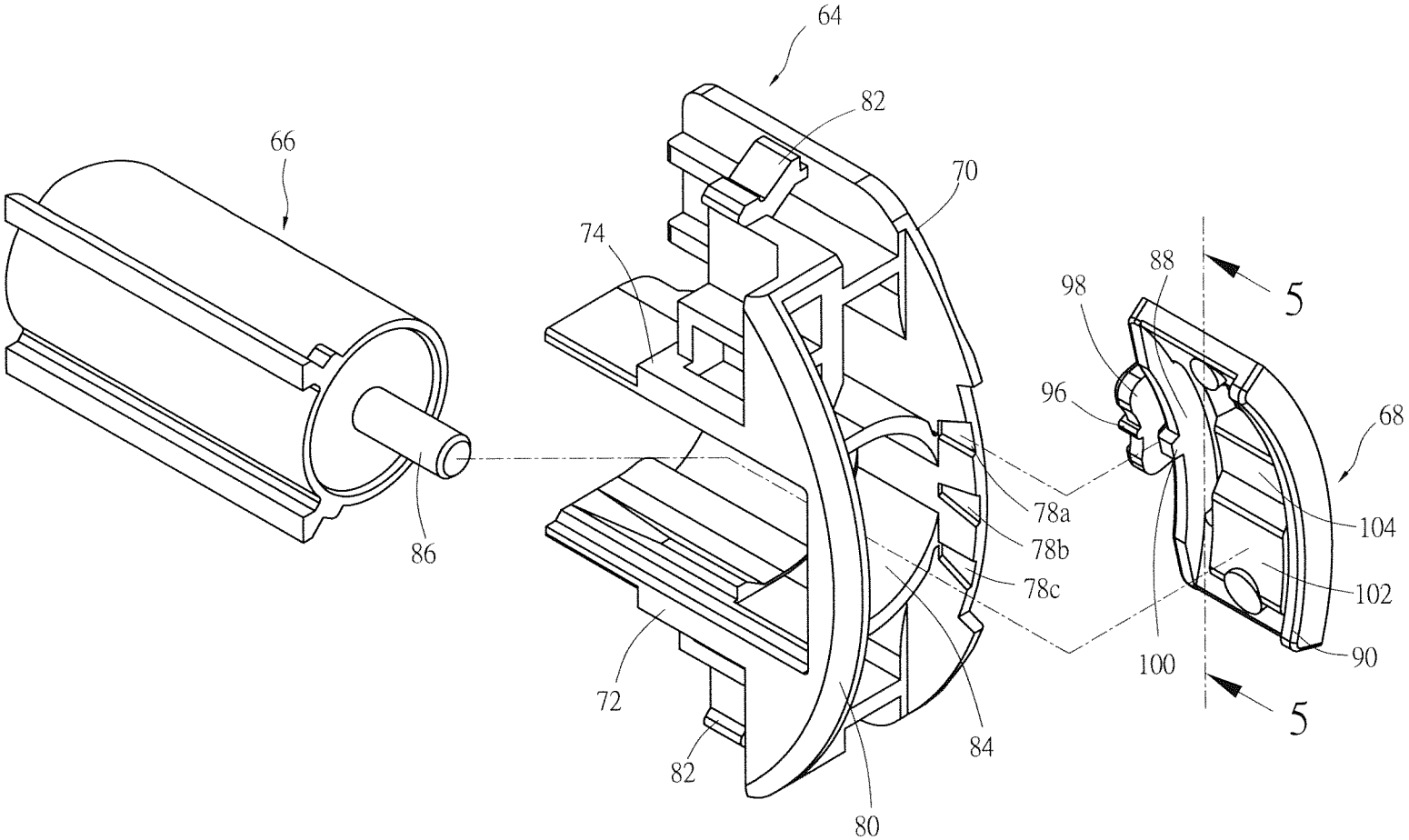
FIG. 3 is an exploded perspective view of the damping device shown in FIG. 1.

As shown in FIG. 2 and FIG. 3, the damping device 12 includes a retainer 64, a damper 66, and an adjusting member 68.

The retainer 64 is mounted in the room 40 of the hinge cup 20. The retainer 64 includes an upper portion 70, a lower portion 72 opposite the upper portion 70, and a main body 74 connected between the upper portion 70 and the lower portion 72.

As shown in FIG. 2, the upper portion 70 has a surface provided with a first mark 76*a*, a second mark 76*b*, and a third mark 76*c*. In addition, as shown in FIG. 3, the upper portion 70 has a peripheral portion facing the rear end wall 32 of the hinge cup 20 and provided with a first engaging part 78*a*, a second engaging part 78*b*, and a third engaging part 78*c*. Preferably, the first mark 76*a*, the second mark 76*b*, and the third mark 76*c* are words, numbers, or graphic marks through which an operator can know and identify each damping action the damping device 12 is capable of.

The lower portion 72 has a peripheral portion provided with a lip 80 and has two lateral sides each provided with an engaging element 82. Each engaging element 82 is engaged with a corresponding positioning hole 38 of the hinge cup 20 such that the retainer 64 is mounted and fixed in the room 40 of the hinge cup 20. The main body 74 has a channel 84.

The damper 66 corresponds to and is movably mounted in the channel 84 of the retainer 64. When the hinge cup 20 is being closed with respect to the hinge arm 22, the damper 66 mounted in the channel 84 of the retainer 64 corresponds to and can be pressed and displaced by the hinge arm 22.

Preferably, the damper 66 has a piston rod 86 which corresponds to and can be pressed against the adjusting member 68. When the piston rod 86 is in a normal state, in which it is not pushed by an external force, a damping medium (not shown) in the damper 66 keeps the piston rod 86 jutting out of the damper 66 so that the piston rod 86, once pushed by an external force, can provide a damping action against the external force. As the principle of the damping action of the damper 66 is readily understandable by a person skilled in the art, further description is omitted herein for the sake of simplicity.

Figure 4:
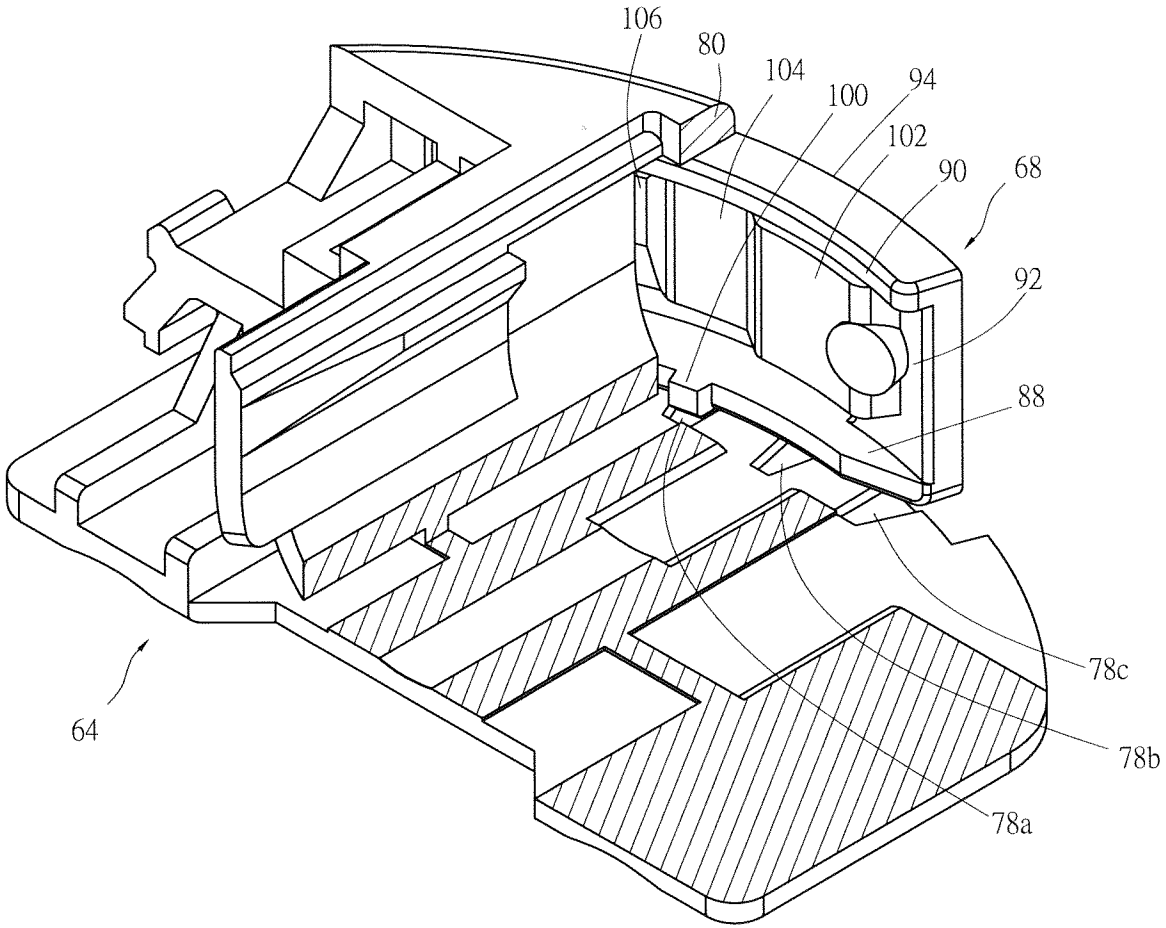
FIG. 4 is an assembled perspective view of the retainer and the adjusting member of the damping device in an embodiment of the present invention.

Referring to FIG. 2~FIG. 4, the adjusting member 68 is movably mounted to the retainer 64 and is located between the upper portion 70 and the lower portion 72 (the lip 80) of the retainer 64. The adjusting member 68 includes an upper frame 88, a lower frame 90 opposite the upper frame 88, and a lateral plate 92 connected between the upper frame 88 and the lower frame 90 and having a surface 94. The adjusting member 68 is movably engaged with the retainer 64 via one of the upper frame 88 and the lower frame 90.

In addition, the upper frame 88 of the adjusting member 68 has a pointed portion 96, an operating portion 98, and an engaging portion 100. When the adjusting member 68 is adjusted by being displaced with respect to the retainer 64, the engaging portion 100 can be selectively disposed in the first engaging part 78*a*, the second engaging part 78*b*, or the third engaging part 78*c* of the retainer 64 so as to engage loosely with and be positioned in that engaging part. In the meantime, the pointed portion 96 is moved to point to a corresponding one of the first mark 76*a*, the second mark 76*b*, and the third mark 76*c* of the retainer 64 in order for the operator to know the position to which the adjusting member 68 has been adjusted. The operating portion 98 makes it easy for the operator to turn the adjusting member 68, i.e., to displace the adjusting member 68 with respect to the retainer 64.

Figure 5:
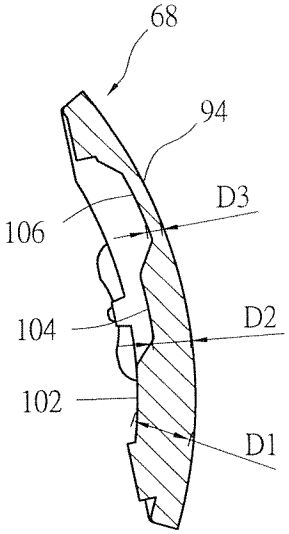
FIG. 5 is a sectional view taken along line 5-5 in FIG. 3, showing in particular the first contact portion, the second contact portion, and the third contact portion of the adjusting member of the damping device.

Referring to FIG. 4 and FIG. 5, the lateral plate 92 of the adjusting member 68 has a first contact portion 102, a second contact portion 104, and a third contact portion 106. The distance between the surface 94 of the lateral plate 92 and the first contact portion 102 is defined as the first distance D1. The distance between the surface 94 of the lateral plate 92 and the second contact portion 104 is defined as the second distance D2. The distance between the surface 94 of the lateral plate 92 and the third contact portion 106 is defined as the third distance D3. The first distance D1 is greater than the second distance D2, and the second distance D2 is greater than the third distance D3.

Figure 6:
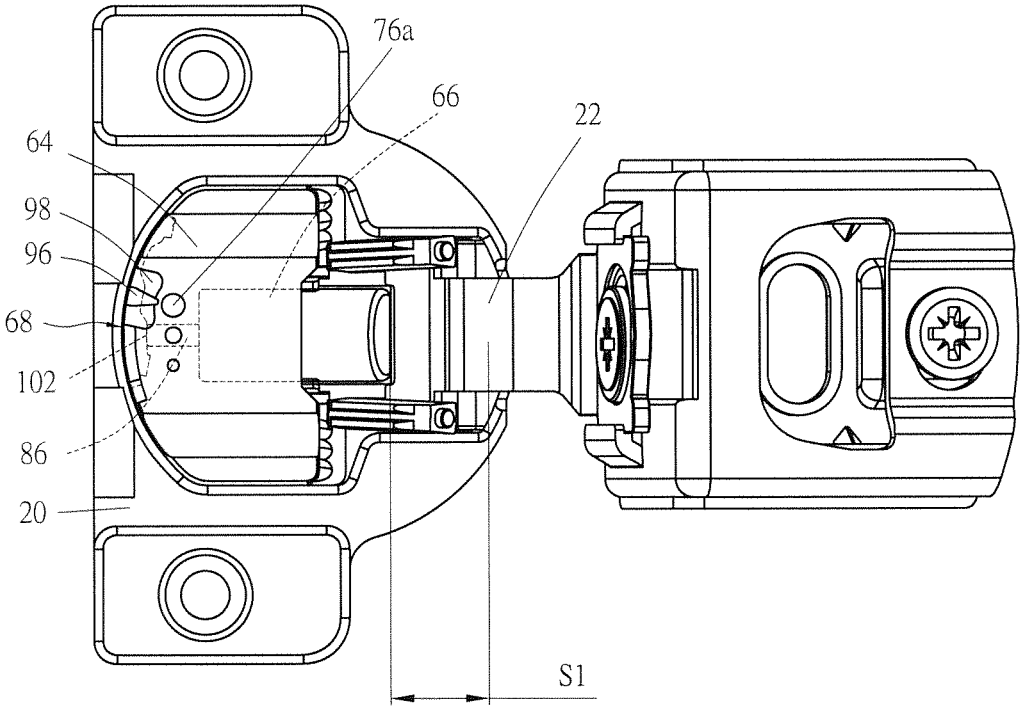
FIG. 6 is a schematic drawing in which the adjusting member in an embodiment of the present invention has been adjusted with respect to the retainer to a first position such that a first space is formed between the damper and the hinge arm.

Referring to FIG. 6 in conjunction with FIG. 3, when the adjusting member 68 is operated via the operating portion 98 and displaced with respect to the retainer 64 to a first position, the engaging portion 100 becomes engaged with the first engaging part 78*a* (see FIG. 4). Consequently, the pointed portion 96 of the adjusting member 68 points to the first mark 76*a*, and the piston rod 86 of the damper 66 corresponds to the first contact portion 102 (see FIG. 6). In this state, a first space S1 is formed between the damper 66 and the hinge arm 22.

Figure 7:
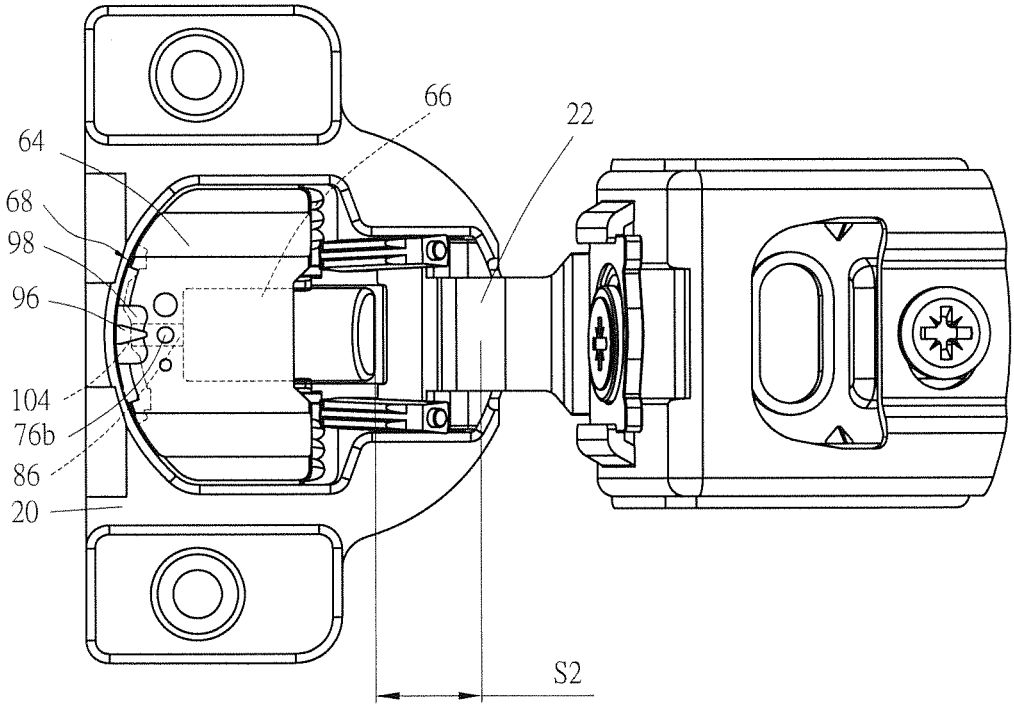
FIG. 7 is a schematic drawing in which the adjusting member in an embodiment of the present invention has been adjusted with respect to the retainer to a second position such that a second space is formed between the damper and the hinge arm.

Referring to FIG. 7 in conjunction with FIG. 3, when the adjusting member 68 is operated via the operating portion 98 and displaced with respect to the retainer 64 to a second position, the engaging portion 100 becomes engaged with the second engaging part 78*b*. Consequently, the pointed portion 96 of the adjusting member 68 points to the second mark 76*b*, and the piston rod 86 of the damper 66 corresponds to the second contact portion 104. In this state, a second space S2 is formed between the damper 66 and the hinge arm 22.

Figure 8:
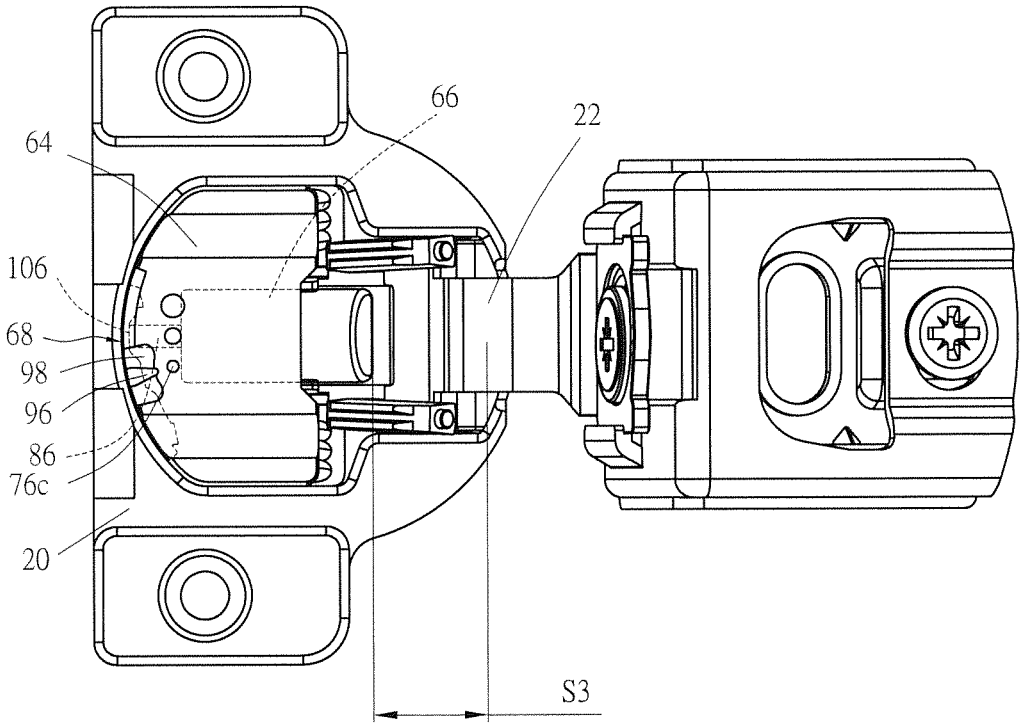
FIG. 8 is a schematic drawing in which the adjusting member in an embodiment of the present invention has been adjusted with respect to the retainer to a third position such that a third space is formed between the damper and the hinge arm.

Referring to FIG. 8 in conjunction with FIG. 3, when the adjusting member 68 is operated via the operating portion 98 and displaced with respect to the retainer 64 to a third position, the engaging portion 100 becomes engaged with the third engaging part 78*c*. Consequently, the pointed portion 96 of the adjusting member 68 points to the third mark 76*c*, and the piston rod 86 of the damper 66 corresponds to the third contact portion 106. In this state, a third space S3 is formed between the damper 66 and the hinge arm 22.

Figure 9B:
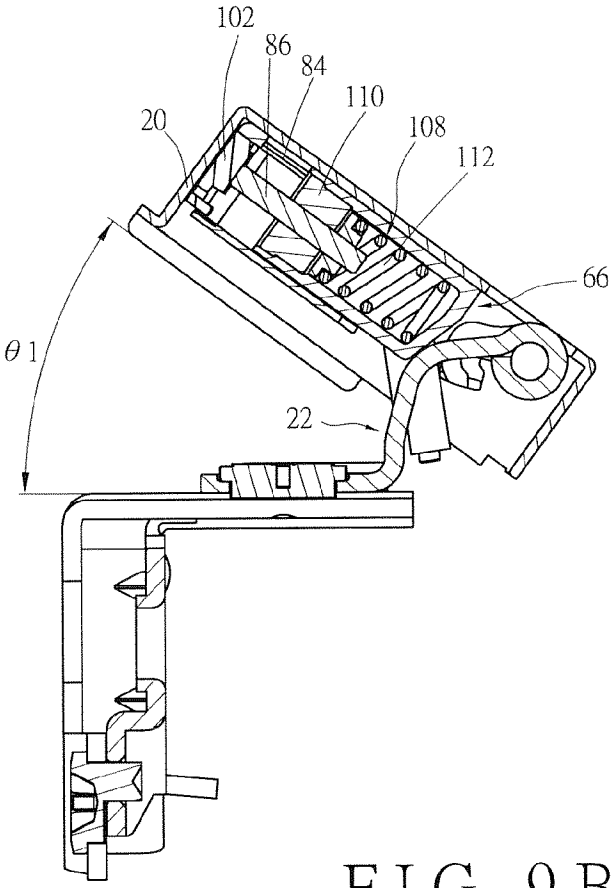
FIG. 9B is a schematic drawing in which the hinge cup in an embodiment of the present invention has been closed with respect to the hinge arm from the open state to a first predetermined angle.
Figure 9A:
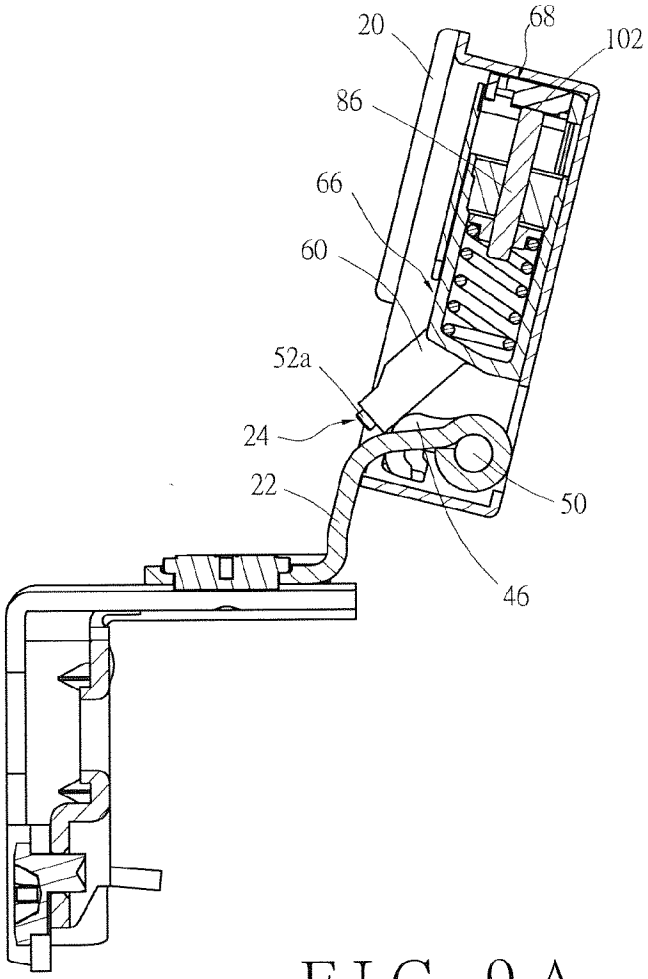
FIG. 9A is a schematic drawing in which the hinge cup in an embodiment of the present invention is an open state with respect to the hinge arm.
Figure 9C:
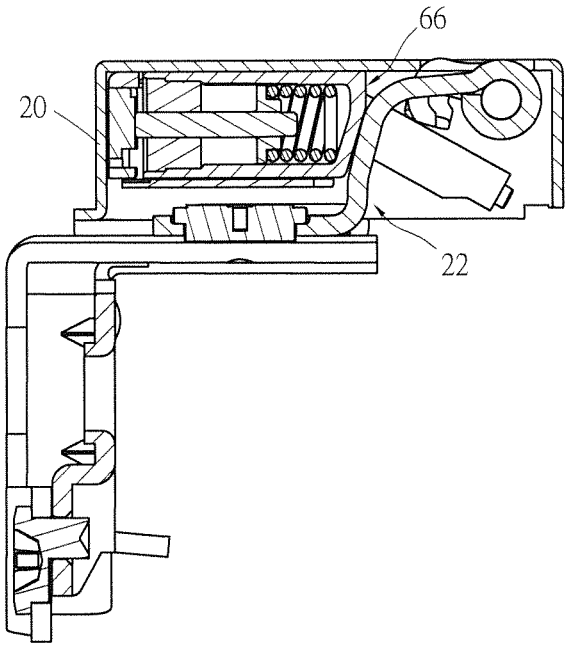
FIG. 9C is a schematic drawing in which the hinge cup in an embodiment of the present invention is in a closed state with respect to the hinge arm.

FIG. 9A~FIG. 9C illustrate how the hinge 10 and damping device 12 in an embodiment of the present invention work after the adjusting member 68 has been adjusted to the first position.

When the adjusting member 68 has been adjusted to the first position and the hinge cup 20 is in an open state with respect to the hinge arm 22 (i.e., the state shown in FIG. 9A), the hinge cup 20 can be pivoted with respect to the hinge arm 22 from the open state to a closed state due to the fact that the hinge arm 22 is pivotally connected to the hinge cup 20 via the shaft 50. During the closing process, the first rods 52*a* of the springs 24 press against the cam portions 46 of the hinge arm 22 via the protective covers 60 respectively, wherein the protective covers 60 serve to protect either the first rods 52*a* of the springs 24 or the cam portions 46 of the hinge arm 22. Moreover, the springs 24 provide a resilient closing force in the last part of the closing movement.

When the hinge cup 20 being closed with respect to the hinge arm 22 goes through the last part of the closing movement (i.e., the state shown in FIG. 9B), the hinge arm 22 pushes the damper 66 in a manner corresponding to the first space S1 such that the piston rod 86 is pressed against the first contact portion 102 of the adjusting member 68. More specifically, only when the hinge cup 20 has been closed with respect to the hinge arm 22 to a first predetermined angle θ1 will the hinge arm 22 be able to push the damper 66 and thereby displace the damper 66 in the channel 84 of the retainer 64. By virtue of the damping medium 108 in the damper 66, the piston rod 86 produces a damping effect until the hinge cup 20 enters a closed state with respect to the hinge arm 22 (i.e., the state shown in FIG. 9C). The damping medium 108 may include a piston 110 and an elastic element 112. Preferably, the damping medium 108 further includes a damping medium fluid. In practice, the damping medium in the damper 66 is not limited to the above and can be designed as needed.

Figure 10:
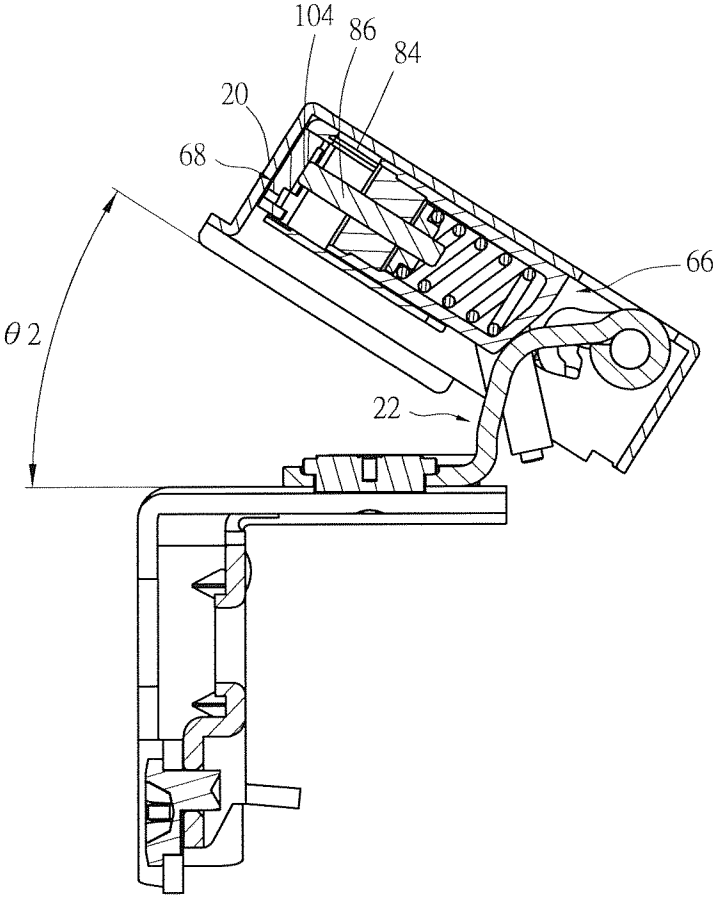
FIG. 10 is a schematic drawing in which the hinge cup in an embodiment of the present invention has been closed with respect to the hinge arm from the open state to a second predetermined angle.

FIG. 10 illustrates how the hinge 10 and damping device 12 in an embodiment of the present invention work after the adjusting member 68 has been adjusted to the second position.

As in the case with the first position, when the adjusting member 68 has been adjusted to the second position and the hinge cup 20 is being closed with respect to the hinge arm 22 and goes through the last part of the closing movement, the hinge arm 22 pushes the damper 66 in a manner corresponding to the second space S2 such that the piston rod 86 is pressed against the second contact portion 104 of the adjusting member 68. More specifically, only when the hinge cup 20 has been closed with respect to the hinge arm 22 to a second predetermined angle θ2 will the hinge arm 22 be able to push the damper 66, causing the damper 66 to displace in the channel 84 of the retainer 64. As a result, the piston rod 86 produces a damping effect until the hinge cup 20 enters a closed state with respect to the hinge arm 22.

Figure 11:
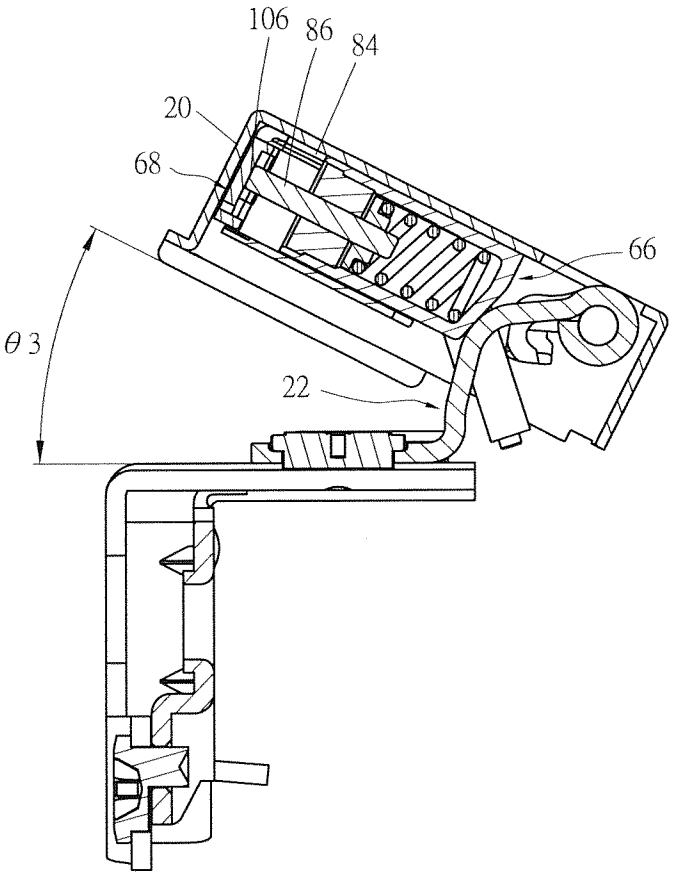
FIG. 11 is a schematic drawing in which the hinge cup in an embodiment of the present invention has been closed with respect to the hinge arm from the open state to a third predetermined angle.

FIG. 11 illustrates how the hinge 10 and damping device 12 in an embodiment of the present invention work after the adjusting member 68 has been adjusted to the third position.

As in the case with the first or the second position, when the adjusting member 68 has been adjusted to the third position and the hinge cup 20 is being closed with respect to the hinge arm 22 and goes through the last part of the closing movement, the hinge arm 22 pushes the damper 66 in a manner corresponding to the third space S3 such that the piston rod 86 is pressed against the third contact portion 106 of the adjusting member 68. More specifically, only when the hinge cup 20 has been closed with respect to the hinge arm 22 to a third predetermined angle θ3 will the hinge arm 22 be able to push the damper 66, causing the damper 66 to displace in the channel 84 of the retainer 64. As a result, the piston rod 86 produces a damping effect until the hinge cup 20 enters a closed state with respect to the hinge arm 22.

According to the above, the adjusting member 68 can be adjusted in position with respect to the retainer 64 so that, when the hinge cup 20 is being closed with respect to the hinge arm 22 and goes through the last part of the closing movement, the hinge arm 22 can push the damper 66 in a way corresponding to the adjustment, allowing the damper 66 to produce the desired damping effect, e.g., the damping effect needed when a door of a cabinet is being closed, with a view to protecting the door (or the cabinet) and eliminating noise which may otherwise be generated when the door is being closed with respect to the fixed portion of the cabinet.

It should be pointed out that the damping device 12 has at least two contact portions 102, 104, 106 which are differently spaced from the surface 94 of the adjusting member 68 and which therefore enable selective adjustment of the damping action of the damping device 12 to satisfy different damping needs.

While the present invention has been disclosed by way of the foregoing preferred embodiments, those embodiments are not intended to be restrictive of the present invention. The scope of patent protection sought for the invention is defined by the appended claims.

The invention claimed is:

1. A hinge, comprising:

a hinge arm;

a hinge cup pivotally connected to the hinge arm, the hinge cup comprising a room;

at least one spring mounted in the room of the hinge cup, the at least one spring providing a resilient closing force when the hinge cup is pivoted, and thereby being closed, with respect to the hinge arm;

a retainer mounted in the room of the hinge cup, the retainer having a channel;

a damper mounted in the channel of the retainer and corresponding to the hinge arm, the damper having a piston rod; and an adjusting member movably mounted to the retainer, the adjusting member comprising a surface, a first contact portion, and a second contact portion, the first contact portion and the surface defining a first distance therebetween, the second contact portion and the surface defining a second distance therebetween, the first distance being greater than the second distance;

wherein when the adjusting member has been displaced with respect to the retainer to a first position, the first contact portion of the adjusting member corresponds to the piston rod of the damper, and when the hinge cup is subsequently closed with respect to the hinge arm, the damper is pushed and displaced by the hinge arm such that the piston rod of the damper is pressed against the first contact portion of the adjusting member and produces a damping effect; and wherein when the adjusting member has been displaced with respect to the retainer to a second position, the second contact portion of the adjusting member corresponds to the piston rod of the damper, and when the hinge cup is subsequently closed with respect to the hinge arm, the damper is pushed and displaced by the hinge arm such that the piston rod of the damper is pressed against the second contact portion of the adjusting member and produces a damping effect.

2. The hinge of claim 1, wherein the adjusting member further comprises a third contact portion, the third contact portion and the surface define a third distance therebetween, and the second distance defined between the second contact portion and the surface is greater than the third distance; and wherein when the adjusting member has been displaced with respect to the retainer to a third position, the third contact portion of the adjusting member corresponds to the piston rod of the damper, and when the hinge cup is subsequently closed with respect to the hinge arm, the damper is pushed and displaced by the hinge arm such that the piston rod of the damper is pressed against the third contact portion of the adjusting member and produces a damping effect.

3. The hinge of claim 1, wherein the adjusting member has an engaging portion, the retainer has an upper portion, and the upper portion has a peripheral portion provided with a first engaging part and a second engaging part; and wherein when the adjusting member has been operated and thereby displaced with respect to the retainer to the first position, the engaging portion of the adjusting member is engaged with the first engaging part of the retainer, and when the adjusting member has been operated and thereby displaced with respect to the retainer to the second position, the engaging portion of the adjusting member is engaged with the second engaging part of the retainer.

4. The hinge of claim 2, wherein the adjusting member has an engaging portion, the retainer has an upper portion, and the upper portion has a peripheral portion provided with a first engaging part, a second engaging part, and a third engaging part; and wherein when the adjusting member has been operated and thereby displaced with respect to the retainer to the first position, the engaging portion of the adjusting member is engaged with the first engaging part of the retainer; when the adjusting member has been operated and thereby displaced with respect to the retainer to the second position, the engaging portion of the adjusting member is engaged with the second engaging part of the retainer; and when the adjusting member has been operated and thereby displaced with respect to the retainer to the third position, the engaging portion of the adjusting member is engaged with the third engaging part of the retainer.

5. The hinge of claim 4, wherein the retainer further has a lower portion opposite the upper portion and has a main body connected between the upper portion and the lower portion of the retainer, the lower portion has a peripheral portion provided with a lip, and the adjusting member is movably mounted between the upper portion and the lip of the lower portion of the retainer.

6. The hinge of claim 5, wherein the adjusting member further comprises an operating portion.

7. The hinge of claim 5, wherein the upper portion of the retainer has a first mark, a second mark and a third mark, and the adjusting member further comprises a pointed portion; and wherein when the adjusting member has been displaced with respect to the retainer to the first position, the pointed portion corresponds to the first mark; when the adjusting member has been displaced with respect to the retainer to the second position, the pointed portion corresponds to the second mark; and when the adjusting member has been displaced with respect to the retainer to the third position, the pointed portion corresponds to the third mark.

8. The hinge of claim 1, wherein the hinge cup further comprises a pair of sidewalls, a bottom wall connected between the pair of sidewalls, a front end wall connected between front ends of the pair of sidewalls, and a rear end wall connected between rear ends of the pair of sidewalls, and the room is defined jointly by the pair of sidewalls, the bottom wall, the front end wall, and the rear end wall.

9. The hinge of claim 1, wherein the hinge cup further comprises a pair of sidewalls and a front end wall connected between front ends of the pair of sidewalls, each said sidewall has a shaft hole adjacent to the front end wall, the shaft hole of one said sidewall corresponds to the shaft hole of the other said sidewall, the hinge arm comprises a pair of cam portions and a bushing connected between the pair of cam portions, and the hinge arm is pivotally connected to the hinge cup by a shaft passing through the shaft hole of each said sidewall and the bushing of the hinge arm.

10. The hinge of claim 1, wherein the at least one spring comprises a pair of springs, the pair of springs are in form of torsion springs, each said spring comprises a winding portion, the hinge cup further comprises a pair of sidewalls and a bottom wall connected between the pair of sidewalls, each said sidewall has a pin hole, the pin hole of one said sidewall corresponds to the pin hole of the other said sidewall, the bottom wall comprises a pair of lugs, each said lug has a through hole corresponding to the pin holes of the pair of sidewalls, each spring is mounted between a corresponding one of the pair of sidewalls and a corresponding one of the pair of lugs and is connected to the hinge cup by a respective pin passing through the pin hole of said corresponding one of the pair of sidewalls, the winding portion of said each spring, and the through hole of said corresponding one of the pair of lugs.

11. The hinge of claim 1, wherein the hinge cup further comprises a pair of sidewalls, each said sidewall has a positioning hole, the positioning hole of one said sidewall corresponds to the positioning hole of the other said sidewall, the retainer has two lateral sides each provided with an engaging element, and each said engaging element corresponds to and is engaged in the positioning hole of a corresponding one of the pair of sidewalls such that the retainer is fixed in the room of the hinge cup.

12. A hinge with a damping device, applicable to a cabinet having a fixed portion and a door, the door being able to be opened and closed with respect to the fixed portion, the hinge comprising a hinge cup mounted to the door of the cabinet, a hinge arm mounted to the fixed portion of the cabinet, and at least one spring, the hinge cup being pivotally connected to the hinge arm, the hinge cup comprising a room, the spring being mounted in the room of the hinge cup, the spring providing a resilient closing force when the hinge cup is pivoted, and thereby being closed, with respect to the hinge arm, the damping device comprising:

a retainer mounted in the room of the hinge cup, the retainer having a channel;

a damper mounted in the channel of the retainer and corresponding to the hinge arm, the damper having a piston rod; and an adjusting member movably mounted to the retainer, the adjusting member comprising a surface, a first contact portion, and a second contact portion, the first contact portion and the surface defining a first distance therebetween, the second contact portion and the surface defining a second distance therebetween, the first distance being greater than the second distance;

wherein when the adjusting member has been displaced with respect to the retainer to a first position, the first contact portion of the adjusting member corresponds to the piston rod of the damper, and when the hinge cup is subsequently closed with respect to the hinge arm, the damper is pushed and displaced by the hinge arm such that the piston rod of the damper is pressed against the first contact portion of the adjusting member and produces a damping effect; and wherein when the adjusting member has been displaced with respect to the retainer to a second position, the second contact portion of the adjusting member corresponds to the piston rod of the damper, and when the hinge cup is subsequently closed with respect to the hinge arm, the damper is pushed and displaced by the hinge arm such that the piston rod of the damper is pressed against the second contact portion of the adjusting member and produces a damping effect.

13. The hinge of claim 12, wherein the adjusting member further comprises a third contact portion, the third contact portion and the surface define a third distance therebetween, and the second distance defined between the second contact portion and the surface is greater than the third distance; and wherein when the adjusting member has been displaced with respect to the retainer to a third position, the third contact portion of the adjusting member corresponds to the piston rod of the damper, and when the hinge cup is subsequently closed with respect to the hinge arm, the damper is pushed and displaced by the hinge arm such that the piston rod of the damper is pressed against the third contact portion of the adjusting member and produces a damping effect.

14. A damping device, comprising:

a retainer having a channel;

a damper mounted in the channel of the retainer, the damper having a piston rod; and an adjusting member movably mounted to the retainer, the adjusting member comprising a surface, a first contact portion, and a second contact portion, the first contact portion and the surface defining a first distance therebetween, the second contact portion and the surface defining a second distance therebetween, the first distance being greater than the second distance;

wherein when the adjusting member has been displaced with respect to the retainer to a first position, the first contact portion of the adjusting member corresponds to the piston rod of the damper, and when the piston rod of the damper is pressed against the first contact portion of the adjusting member, the piston rod of the damper produces a damping effect; and wherein when the adjusting member has been displaced with respect to the retainer to a second position, the second contact portion of the adjusting member corresponds to the piston rod of the damper, and when the piston rod of the damper is pressed against the second contact portion of the adjusting member, the piston rod of the damper produces a damping effect.

15. The damping device of claim 14, wherein the adjusting member further comprises a third contact portion, the third contact portion and the surface define a third distance therebetween, and the second distance defined between the second contact portion and the surface is greater than the third distance; and wherein when the adjusting member has been displaced with respect to the retainer to a third position, the third contact portion of the adjusting member corresponds to the piston rod of the damper, and when the piston rod of the damper is pressed against the third contact portion of the adjusting member, the piston rod of the damper produces a damping effect.

16. The damping device of claim 14, wherein the adjusting member has an engaging portion, the retainer has an upper portion, and the upper portion has a peripheral portion provided with a first engaging part and a second engaging part; and wherein when the adjusting member has been operated and thereby displaced with respect to the retainer to the first position, the engaging portion of the adjusting member is engaged with the first engaging part of the retainer, and when the adjusting member has been operated and thereby displaced with respect to the retainer to the second position, the engaging portion of the adjusting member is engaged with the second engaging part of the retainer.

17. The damping device of claim 15, wherein the adjusting member has an engaging portion, the retainer has an upper portion, and the upper portion has a peripheral portion provided with a first engaging part, a second engaging part, and a third engaging part; and wherein when the adjusting member has been operated and thereby displaced with respect to the retainer to the first position, the engaging portion of the adjusting member is engaged with the first engaging part of the retainer; when the adjusting member has been operated and thereby displaced with respect to the retainer to the second position, the engaging portion of the adjusting member is engaged with the second engaging part of the retainer; and when the adjusting member has been operated and thereby displaced with respect to the retainer to the third position, the engaging portion of the adjusting member is engaged with the third engaging part of the retainer.

18. The damping device of claim 17, wherein the retainer further has a lower portion opposite the upper portion and has a main body connected between the upper portion and the lower portion of the retainer, the lower portion has a peripheral portion provided with a lip, and the adjusting member is movably mounted between the upper portion and the lip of the lower portion of the retainer.

19. The damping device of claim 18, wherein the adjusting member further comprises an operating portion.

20. The damping device of claim 18, wherein the upper portion of the retainer has a first mark, a second mark, and a third mark, and the adjusting member further comprises a pointed portion; and wherein when the adjusting member has been displaced with respect to the retainer to the first position, the pointed portion corresponds to the first mark; when the adjusting member has been displaced with respect to the retainer to the second position, the pointed portion corresponds to the second mark; and when the adjusting member has been displaced with respect to the retainer to the third position, the pointed portion corresponds to the third mark.

* * * * *